US012767276B2

(12) United States Patent
Stephen

(10) Patent No.: US 12,767,276 B2
(45) Date of Patent: Oct. 20, 2026

(54) OVER-THE-DECK SUPPORT FRAME ASSEMBLY, BIMINI AND WATERCRAFT HAVING SAME

(71) Applicant: BRP MARINE US INC., Clinton, MI (US)

(72) Inventor: Ryan Stephen, Mount Pleasant, WI (US)

(73) Assignee: BRP MARINE US INC., Clinton, MI (US)

( * ) Notice: Subject to any disclaimer, the term of this patent is extended or adjusted under 35 U.S.C. 154(b) by 582 days.

(21) Appl. No.: 18/362,049

(22) Filed: Jul. 31, 2023

(65) Prior Publication Data

US 2025/0019043 A1 Jan. 16, 2025

Related U.S. Application Data

(60) Provisional application No. 63/513,683, filed on Jul. 14, 2023.

(51) Int. Cl.
*B63B 17/02* (2006.01)
*B63B 17/00* (2006.01)

(52) U.S. Cl.
CPC ..... *B63B 17/02* (2013.01); *B63B 2017/0054* (2013.01)

(58) Field of Classification Search
CPC ..... B63B 17/00; B63B 17/02; B63B 17/023; B63B 2017/0054
USPC ..... 114/361
See application file for complete search history.

(56) References Cited

U.S. PATENT DOCUMENTS 12,071,202 B2 * 8/2024 Morgan ..... B63B 17/02
2023/0278672 A1 * 9/2023 Mazzarelli ..... B63B 17/02 114/361

* cited by examiner

*Primary Examiner* — Lars A Olson
(74) *Attorney, Agent, or Firm* — BCF LLP

(57) ABSTRACT

An over-the-deck support frame assembly includes first and second brackets, each having one of a tapered end and a tapered recess, and a support pivotable between stowed and upright positions and having first and second members respectively pivotable relative to the first and second brackets. Each one of the first and second members has an other one of the tapered end and the tapered recess that is complementary to and engageable with a corresponding one of the tapered end and the tapered recess. With the support in the upright position, the engagement is such that at least part of the other one of the tapered end and the tapered recess of the first and second member contacts at least part of the one of the tapered end and the tapered recess of the first and second brackets. Bimini and watercraft having the over-the-deck support frame assembly are also disclosed.

20 Claims, 7 Drawing Sheets

OVER-THE-DECK SUPPORT FRAME ASSEMBLY, BIMINI AND WATERCRAFT HAVING SAME

CROSS-REFERENCE

The present application claims priority to U.S. Provisional Patent Application No. 63/513,683, filed Jul. 14, 2023 entitled "Over-the-Deck Support Frame Assembly, Bimini and Watercraft Having Same", which is incorporated by reference herein in its entirety.

TECHNOLOGICAL FIELD

The present technology relates to over-the-deck support frame assemblies, biminis having an over-the-deck support frame assembly and watercraft having an over-the-deck support frame assembly.

BACKGROUND

Some watercraft have over-the-deck support frame assemblies which can be used as towing towers and/or as support assemblies for biminis. These over-the-deck support frame assemblies are generally adjustable between extended and collapsed configurations.

Generally, when these over-the-deck support frame assemblies are used for biminis, they can only be used in their extended configuration at low speeds. While some over-the-deck support frame assemblies can be used at higher speeds, the structure of these over-the-deck support frame assemblies are generally more robust, which can make them more difficult to manipulate, and more expensive to manufacture.

In view of the foregoing, there is a desire for an over-the-deck support frame assembly that can be used at higher speeds while being easy to manipulate and not being expensive to manufacture.

SUMMARY

It is an object of the present technology to ameliorate at least some of the inconveniences present in the prior art.

According to one aspect of the present technology, there is provided an over-the-deck support frame assembly for a watercraft. The over-the-deck support frame assembly includes first and second brackets and a support. The first and second brackets are connectable to the watercraft on opposite sides of a longitudinal center plane of the watercraft, and each one of the first and second brackets has one of a tapered end and a tapered recess. The support has a first member and a second member laterally spaced from the first member. The first member is pivotable relative to the first bracket, the second member is pivotable relative to the second bracket, and each one of the first and second members have an other one of the tapered end and the tapered recess. Each one of the other one of tapered end and the tapered recess is complementary to and engageable with the one of the tapered end and the tapered recess of a corresponding one of the first and second brackets. The support is selectively pivotable between a stowed position and an upright position. With the support in the upright position, the other one of the tapered end and the tapered recess of the first member engaging the one of the tapered end and the tapered recess of the first bracket such that at least part of the other one of the tapered end and the tapered recess of the first member contacts at least part of the one of the tapered end and the tapered recess of the first bracket, and the other one of the tapered end and the tapered recess of the second member engaging the one of the tapered end and the tapered recess of the second bracket such that at least part of the other one of the tapered end and the tapered recess of the second member contacts at least part of the one of the tapered end and the tapered recess of the second bracket.

In some embodiments, the first member is pivotally connected to the first bracket, and the second member is pivotally connected to the second member.

In some embodiments, at least one of the one of the tapered end and the tapered recess of the first and second brackets is the tapered recess, and at least one of the other one of the tapered end and the tapered recess of the first and second supports is the tapered end.

In some embodiments, each one of the one of the tapered end and the tapered recess of the first and second brackets is the tapered recess, and each one of the other one of the tapered end and the tapered recess of the first and second supports is the tapered end.

In some embodiments, the over-the-deck support frame assembly further includes at least one biasing member connected to the support for biasing the support toward the upright position.

In some embodiments, the at least one biasing member has a first end pivotally connected to the support, and a second end pivotally connected to one of the first and second brackets.

In some embodiments, the at least one biasing member is a traction spring.

In some embodiments, the at least one biasing member includes a first biasing member and a second biasing member, the first biasing member being connected to the first member and to the first bracket, and the second biasing member being connected to the second member and to the second bracket.

In some embodiments, the over-the-deck support frame assembly further includes a locking element engageable with the support and one of the first and second brackets for locking the support in the upright position.

In some embodiments, the locking element is a locking pin extending at least partially through at least one of: the one of the tapered end and the tapered recess of the one of the first and second brackets, and the other one of the tapered end and the tapered recess of a corresponding one of the first and second members.

In some embodiments, each one of the first and second members has a front segment and a rear segment, the first and second members being pivotally connected to corresponding ones of the first and second brackets by the front segments, and the other one of the tapered end and the tapered recess being defined by the rear segments.

According to another aspect of the present technology, there is provided a bimini for a watercraft. The bimini includes the over-the-deck support frame assembly according to the above aspect or according to the above aspect and one or more of the above embodiments, in which the support is a first support, a second support and a top. The second support is pivotally connected to the first support, and moveable between an open position and a closed position. The top extends between the first support and the second support. With the first support in the upright position, and the second support in the open position, the bimini is in an extended configuration, and the top is taut between the first and second supports.

In some embodiments, the bimini further includes a third support pivotally connected to the second support. With the bimini in the extended configuration, the third support is pivotable to a position between the first and second supports for supporting the top.

In some embodiments, the bimini further includes at least one tension member for retaining the second support in the open position. A first end of the at least one tension member is connected to one of the first and second brackets, and a second end of the at least one tension member is connected to the second support. A position of a connection between the second end of the at least one tension member and the second support being moveable along a length of the second support.

According to another aspect of the present technology, there is provided a watercraft including a hull, a deck disposed on the hull, and an over-the-deck support frame assembly. The over-the-deck support frame assembly includes first and second brackets, and a first support. The first and second brackets are connected to the watercraft, and are disposed on opposite sides of a longitudinal center plane of the watercraft. Each one of the first and second brackets have one of a tapered end and a tapered recess. The first support has a first member pivotable relative to the first bracket, a second member pivotable relative to the second bracket, and each one of the first and second members have an other one of the tapered end and the tapered recess. Each one of the other one of the tapered end and the tapered recess is complementary to and engageable with the one of the tapered end and the tapered recess of a corresponding one of the first and second brackets. The first support is selectively pivotable between a stowed position and an upright position. With the first support in the upright position the other one of the tapered end and the tapered recess of the first member engaging the one of the tapered end and the tapered recess of the first bracket such that at least part of the other one of the tapered end and the tapered recess of the first member contacts at least part of one of the tapered end and the tapered recess of the first bracket, and the other one of the tapered end and the tapered recess of the second member engaging the one of the tapered end and the tapered recess of the second bracket such that at least part of the other one of the tapered end and the tapered recess of the second member contacts at least part of the other one of the tapered end and the tapered recess of the second bracket.

In some embodiments, the first bracket is connected to a first anchoring structure of the watercraft, and the second bracket is connected to a second anchoring structure of the watercraft.

In some embodiments, the first and second anchoring structures extend above the deck of the watercraft.

In some embodiments, with the first support being in the upright position, the first support is at a non-perpendicular angle about a horizontal plane.

In some embodiments, with the first support being in the upright position, the first support extends longitudinally forward and vertically upward.

In some embodiments, the watercraft further includes a second support and a top. The second support is pivotally connected to the first support, and is moveable between an open position and a closed position. The top extends between the first and second supports, and with the first support being in the upright position, and the second support being in the open position, the top is taut.

For purposes of the present application, terms related to spatial orientation when referring to a watercraft and components in relation to the watercraft, such as "vertical", "horizontal", "forwardly", "rearwardly", "left", "right", "above" and "below", are as they would be understood by a driver of the watercraft sitting thereon in an upright driving position, with the watercraft being at rest and level.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
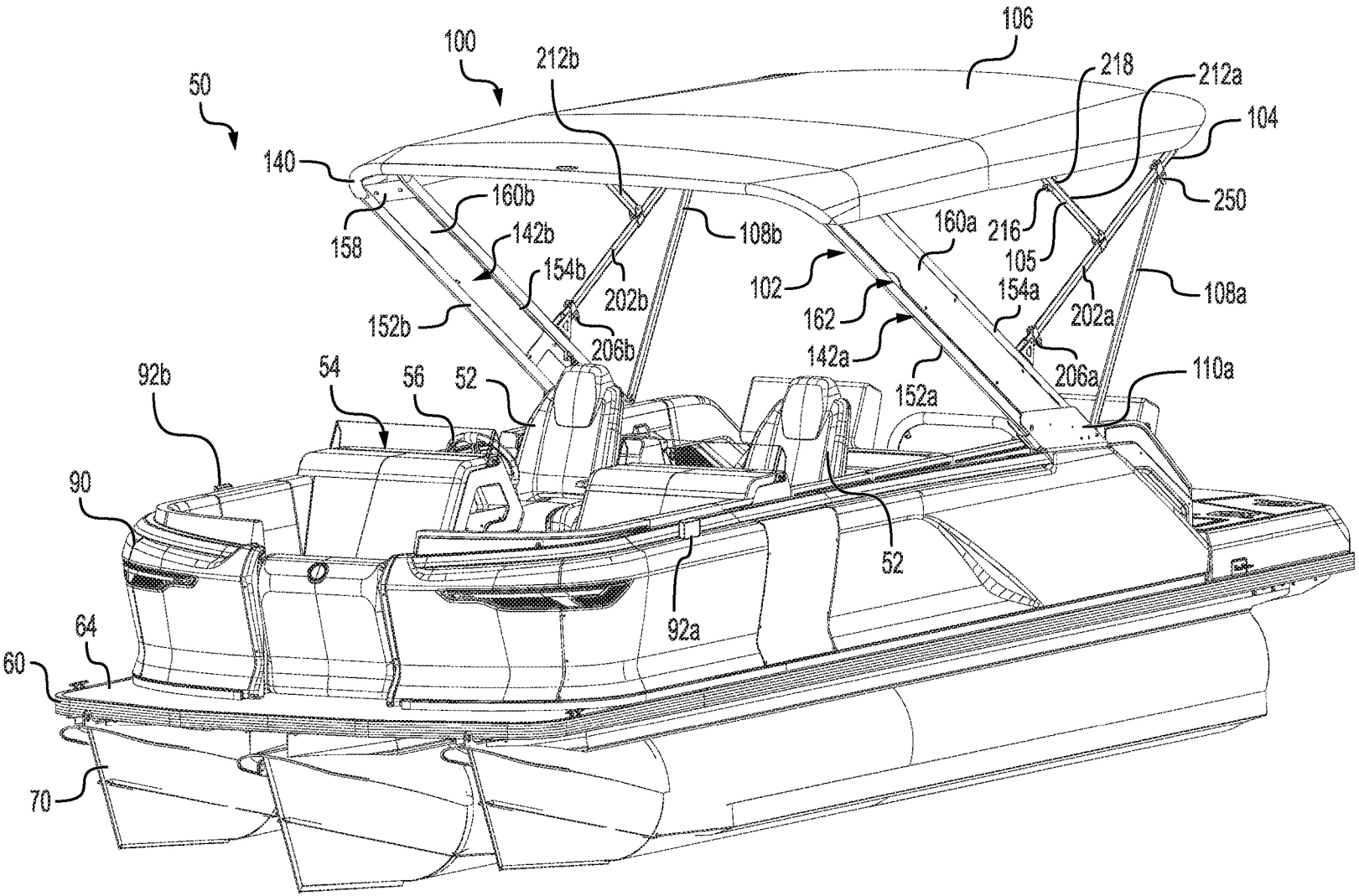
FIG. 1 is a perspective view taken from a top, front, left side of a boat with a bimini having an over-the-deck support frame assembly and brackets according to embodiments of the present technology.
Figure 2:
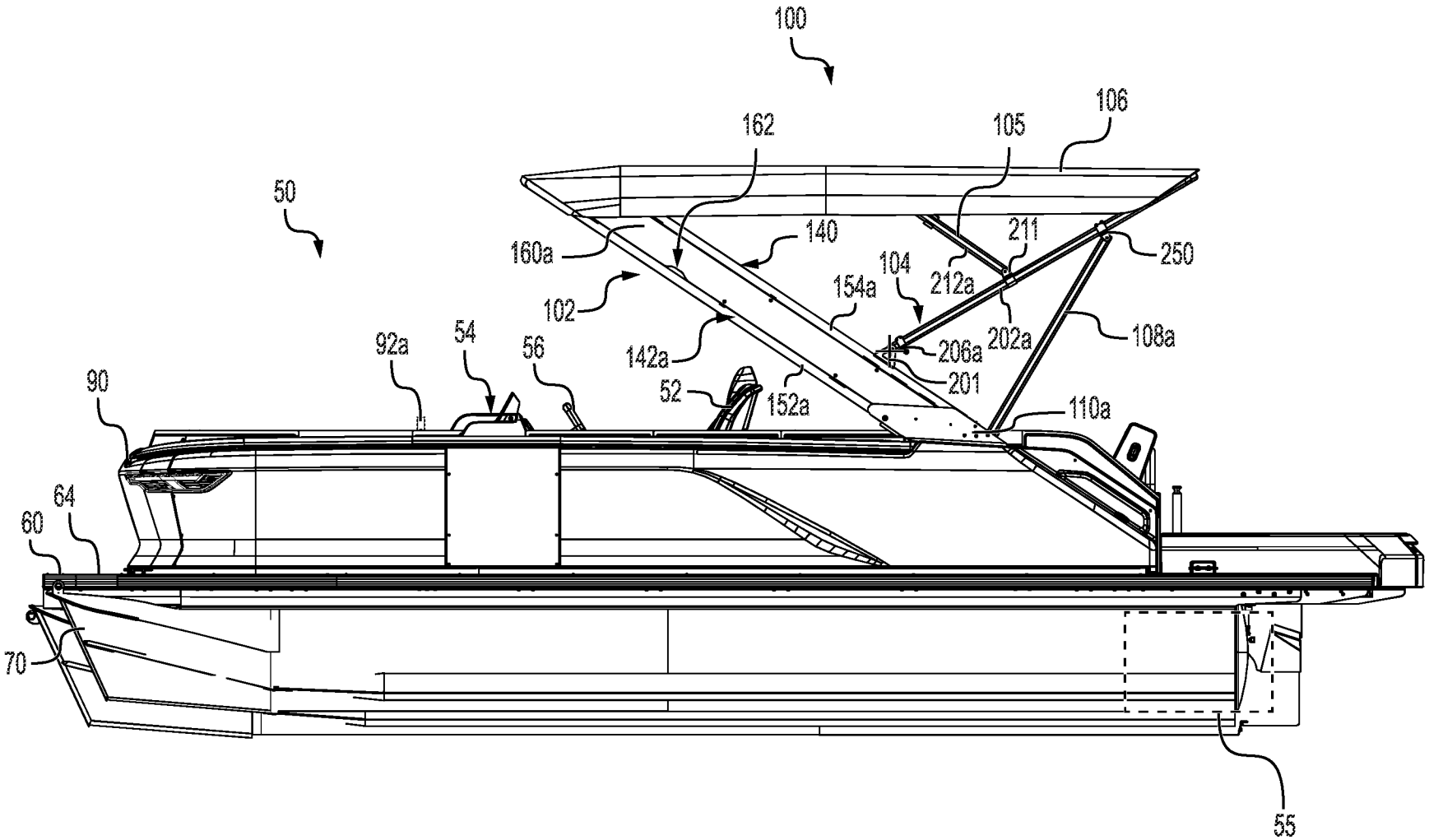
FIG. 2 is a left side elevation view of the boat of FIG. 1.

A watercraft 50 in accordance with one embodiment of the present technology is shown in FIGS. 1 and 2. The following description relates to one example of a watercraft 50, notably a pontoon boat 50. Those of ordinary skill in the art will recognize that there are other known types of watercraft incorporating different designs and that the present technology would encompass these other watercraft.

The boat 50 has a deck 60 and a hull 70. The deck 60 is disposed on the hull 70, and is supported thereby. The deck 60 has an upper surface 64 for supporting occupants, as well as accessories and accommodations of the boat 50 including seats 52 and a command console 54. It is contemplated that the deck 60 could include multiple levels and/or other seating or other accessories integrated therein.

The boat 50 is propelled by a jet propulsion system (not shown) powered by a motor (not shown). The jet propulsion system has a steering nozzle (not shown) used for steering the boat 50. A steering wheel 56, which is disposed on the command console 54, is operatively connected to the steering nozzle. A throttle lever (not shown) is operatively connected to the motor for controlling operation of the motor. The steering device and the throttle lever are located on the command console 54. It is contemplated that other propulsion systems, such as a stern drive, marine outboard engine or marine inboard engine, may be used to propel the boat 50. It is also contemplated that the steering nozzle could be replaced by an outdrive or one or more rudders.

A powerpack 55 (schematically illustrated in FIG. 2) of the boat 50, including the jet propulsion system and the motor, is enclosed in part by the hull 70.

The boat 50 has a side structure 90 surrounding at least part of the deck 60 and extending upwardly therefrom. In the present embodiment, the side structure 90 is a barrier structure 90. It is contemplated that that in some embodiments, the side structure 90 could be gunnels of the boat 50 or another type of structure. The barrier structure 90 is located along a periphery of the boat 50 (as defined by the deck 60). As best seen in FIG. 1, the barrier structure 90 generally covers the front, left and right sides of the deck 60. It is contemplated that, in other embodiments, the barrier structure 90 could surround the deck 60 completely. The boat 50 has a left bimini tiedown 92*a* connected to an upper surface of the barrier structure 90 on a left side of the boat 50, and a right bimini tiedown 92*b* connected to an upper surface of the barrier structure 90 on a right side of the boat 50.

The boat 50 has a bimini 100, which includes an over-the-deck support frame assembly 102 (henceforth referred to as the support frame assembly 102), a rear support 104 that is pivotally connected to the support frame assembly 102, an intermediate support 105 pivotally connected to the rear support 104, left and right tensions members 108*a*, 108*b*, as well as a top 106 that connected to the support frame assembly 102 and to the rear support 104.

Figure 7:
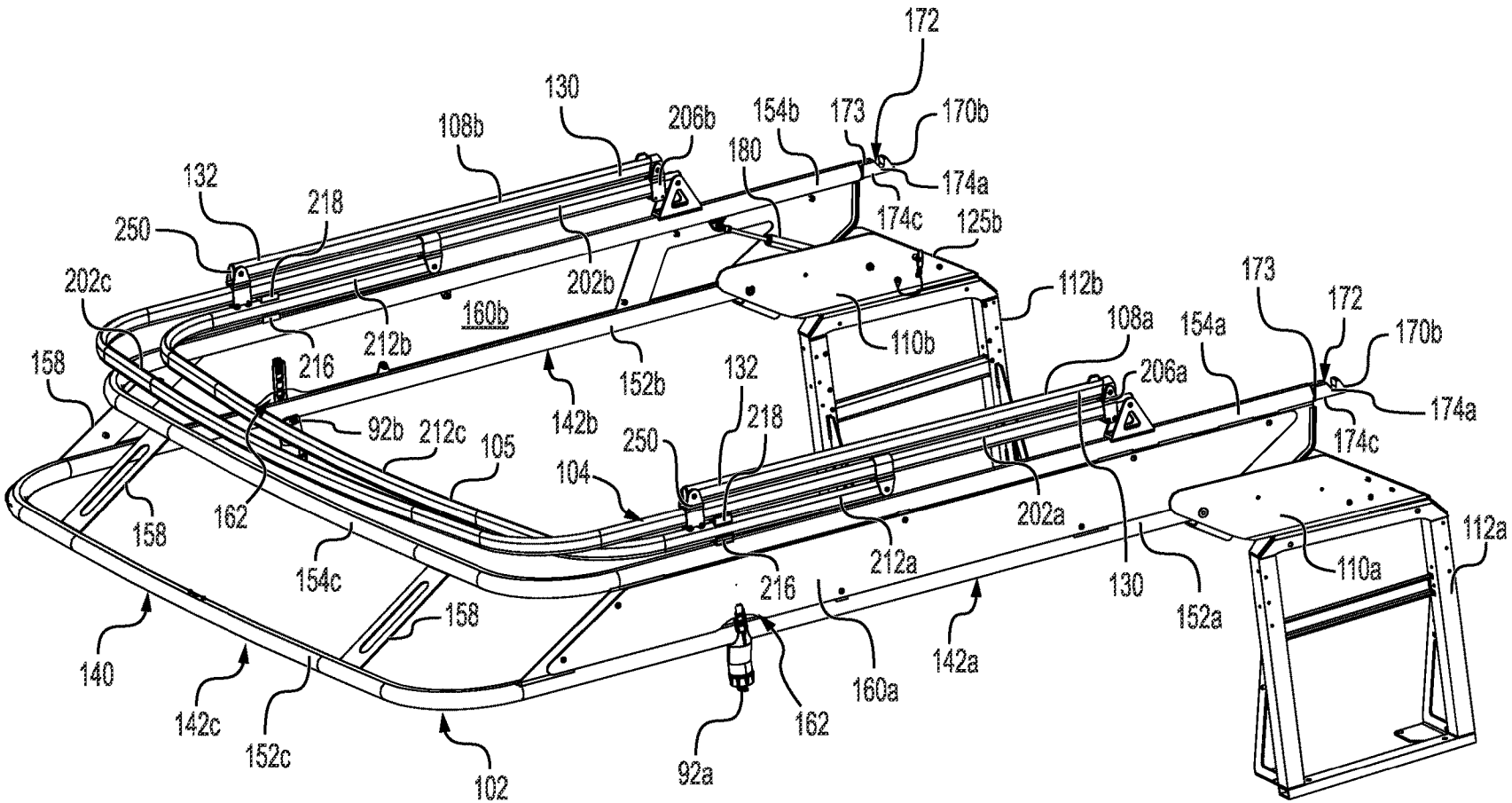
FIG. 7 is a perspective view taken from a top, front, left side of the bimini of FIG. 1 connected to the anchoring structures, the bimini being in a collapsed configuration with the top removed for clarity.

The bimini 100 is adjustable between an extended configuration (shown in FIGS. 1 to 3) and a collapsed configuration (shown in FIG. 7). In the present embodiment, the top 106 is made of a waterproof canvas panel, such as a woven polyester fabric with a polyurethane coating, although other materials are contemplated. In the extended configuration of the bimini 100, the top 106 is taut between the support frame assembly 102 and the rear support 104, and can thereby provide some shade and/or provide shelter from rain to riders of the boat 50. In the collapsed configuration thereof, the top 106 is folded between the support frame assembly 102 and the rear support 104. With the bimini 100 being in the collapsed configuration, putting the boat 50 in storage and/or placing the boat 50 on a trailer is facilitated. The collapsed configuration can also be used when the boat 50 is to be docked for prolonged periods or when the boat 50 has to pass under a low bridge.

The top 106 consists of one integral flexible piece. It is contemplated that the top 106 could be made of two or more distinct pieces that are selectively connected to one another. The flexibility of the top 106 enables the top 106 to fold, as the bimini 100 moves between the extended and collapsed configurations. In some instances, the top 106 may be folded into a compartment. In some instances, the compartment can be defined by one of the front and/or rear supports 140, 104.

With reference to FIGS. 3 to 7, the support frame assembly 102 will now be described. It is to be noted that while the support frame assembly 102 is described herein with reference to the bimini 100, the support frame assembly 102 could be provided as a standalone assembly (i.e., without the rear and intermediate supports 104, 105, the top 106, and the left and right tension members 108*a*, 108*b*). For example, in some embodiments of the present technology, the support frame assembly 102 could be provided on the boat 50 as a towing tower assembly, such as a wakeboard tower. It is also contemplated that the support frame assembly 102 could be used to support a dodger or hardtop instead of the top 106.

The support frame assembly 102 includes a left bracket 110*a*, a right bracket 110*b*, a front support 140, which includes left, right and middle members 142*a*, 142*b*, 142*c*, left and right locking elements 125*a*, 125*b* and left and right biasing members 180 (only right biasing member 180 shown in accompanying Figures). The support frame assembly 102 is configured such that the front support 140 is pivotable relative to the boat 50 between an upright position (shown in FIGS. 1 to 3) and a stowed position (shown in FIG. 7).

The left and right brackets 110*a*, 110*b* are connected to left and right sides of the boat 50 respectively, such that the left and right brackets 110*a*, 110*b* are connected to opposite sides of a longitudinal center plane of the boat 50. In the illustrated embodiment, the left and right brackets 110*a*, 110*b* are connected to the barrier structure 90. More specifically, the left and right brackets 110*a*, 110*b* are respectively connected to left and right anchoring structures 112*a*, 112*b*, which are part of the barrier structure 90. In some embodiments, the left and right brackets 110*a*, 110*b* could be connected to left and right anchoring structures 112*a*, 112*b* that are separate from the barrier structure 90. Thus, in some embodiments, the left and right brackets 110*a*, 110*b* could not be connected to the barrier structure 90. It is further contemplated that in some embodiments, the left and right anchoring structures 112*a*, 112*b* could be omitted, and the left and right brackets 110*a*, 110*b* could be connected elsewhere on the boat 50, such as, for example, to gunnels of the boat 50.

Figure 4:
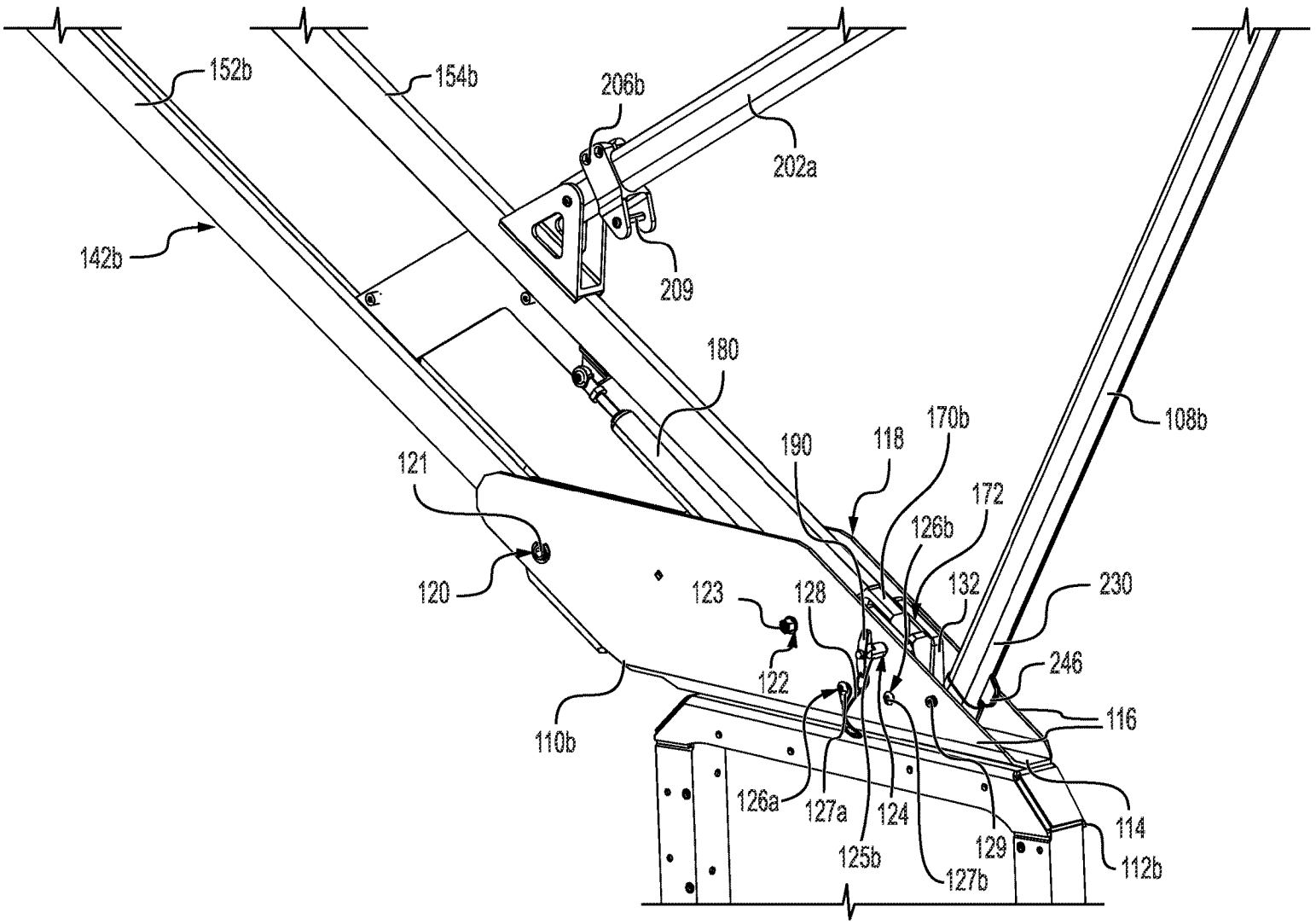
FIG. 4 is a close-up of a part of the bimini of FIG. 3, with a side panel thereof being omitted.
Figure 5:
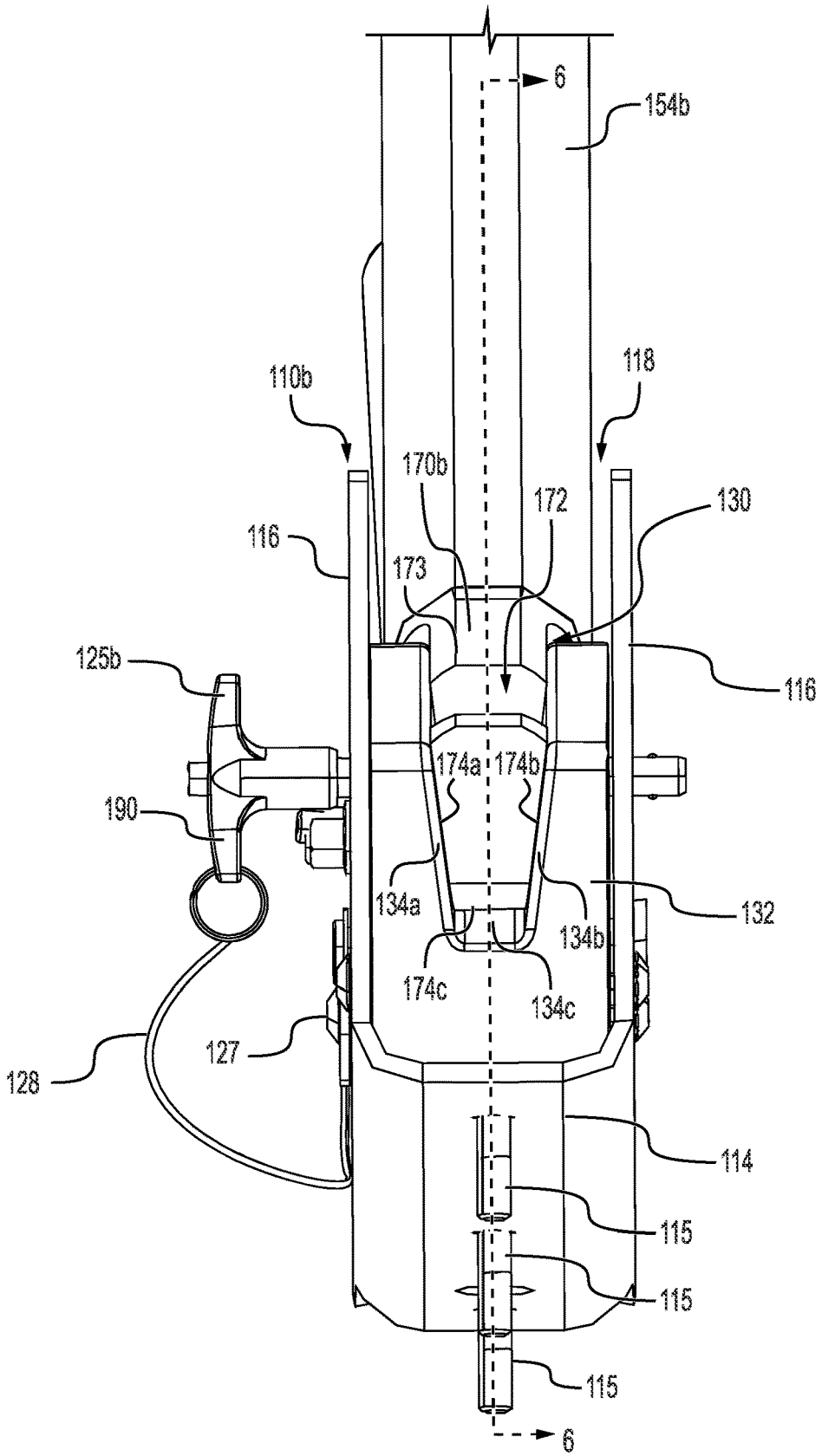
FIG. 5 is a perspective view taken from a bottom, rear side of the bracket of FIG. 4 with a tension member being omitted.
Figure 6:
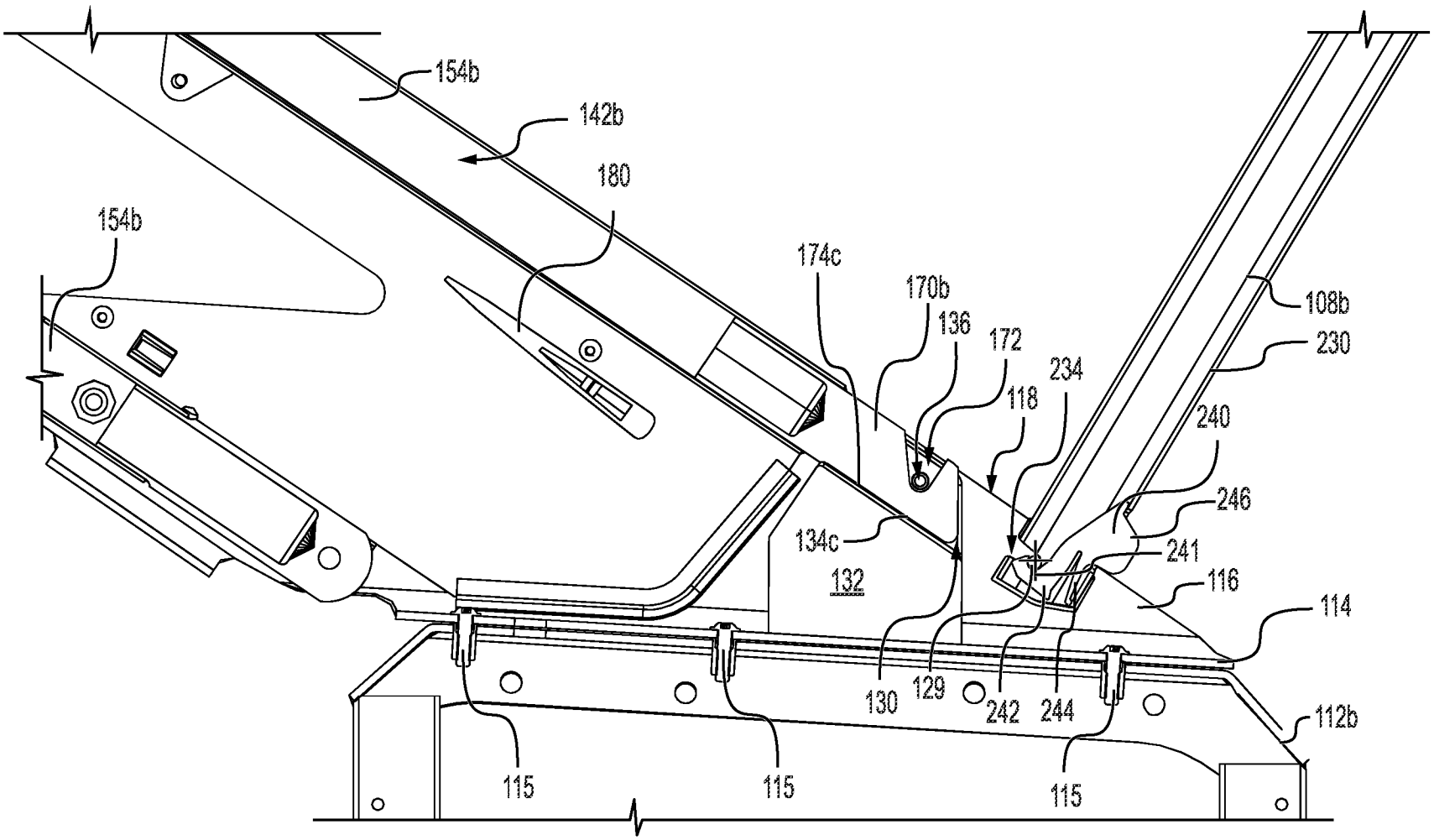
FIG. 6 is a cross-sectional view the part of the bimini of FIG. 4 taken along lines 6-6 of FIG. 5.

Referring to FIGS. 4 to 6, as the left and right brackets 110*a*, 110*b* are similar, only the right bracket 110*b* will be described in detail herewith.

The right bracket 110*b* has a bottom wall 114, which is mounted to the right anchoring structure 112*b* via fasteners 115 (best seen in FIGS. 5 and 6), and laterally spaced sidewalls 116, which extend upwardly and longitudinally forward from the bottom wall 114. It is contemplated that in some embodiments, the bottom wall 114 could be integrally formed with the right anchoring structure 112*b*. It is also contemplated that the bottom wall 114 could be connected to the right anchoring structure 112*b* differently, for example via welding.

The sidewalls 116 are generally shaped like a parallelogram. It is contemplated that the sidewalls 116 could be shaped differently in other embodiments. The sidewalls 116 are laterally spaced from one another, such that there is an interior sidewall 116 and an exterior sidewall 116, and such that the right bracket 110*b* defines a channel 118, that is, as will be described in greater detail below, configured to partially receive the right member 142*b* therein. The channel 118 is open at its front, rear and top sides.

The sidewalls 116 each define a front aperture 120 that receives a fastener 121 therein that pivotally connects the right member 142*b* to the right bracket 110*b*, a middle aperture 122 that receives a fastener 123 therein that pivotally connects one end of the right biasing member 180 to the right bracket 110*b*, and a rear aperture 124 that receives the right locking element 125*b* therein. Each of the sidewalls 116 also defines retaining apertures 126*a*, 126*b* that receive, respectively, retainers 127*a*, 127*b*. In the illustrated embodiment, the retainers 127*a*, 127*b* are fasteners, but other types of retainers are contemplated. On the interior sidewall 116, the retainer 127*a* is connected to the right locking element 125*b* via a wire 128. In other embodiments, the wire 128 could be omitted. A crossbar 129 extends between the sidewalls 116. As will be described below, the right tension member 180*b* is selectively connected to the crossbar 129. It is contemplated that in some embodiments, only one of the sidewalls 116 could define one or more of the front, middle and rear apertures 120, 122, 124. It is further contemplated that there could be more or fewer apertures defined in the sidewalls 116.

Referring to FIGS. 5 and 6, the right bracket 110*b* defines a tapered recess 130. More specifically, in the illustrated embodiment, the left bracket 110*a* has an insert 132 that is disposed in the channel 118. In some embodiments, the insert 132 is sized to have an interference or a transition fit in the channel 118, such that the insert 132 abuts against the sidewalls 116, as well as the bottom wall 114. The insert 132 is connected to the right bracket 110*b* by the retainers 127*a*, 127*b*. The insert 132 defines the tapered recess 130, such that the insert 132 has lateral abutting surfaces 134*a*, 134*b* and a lower abutting surface 134*c*. The tapered recess 130 is tapered such that a lateral width thereof decreases along a height of the right bracket 110*b*. In the illustrated embodiment, the lateral width of the tapered recess 130 at an upper end thereof is greater than the lateral width of the tapered recess 130 at a vertically lower end thereof. Thus, the lateral and lower abutting surfaces 134*a*, 134*b*, 134*c* define a generally flat-bottomed V-shape. The insert 132 and the tapered recess 130 are configured such that the lower abutting surface 134*c* extends longitudinally forward and upwardly, resulting in the lower abutting surface 134*c* being at an angle relative to a horizontal plane. Thus, a longitudinally forward end of the lower abutting surface 134*c* is vertically higher than a longitudinally rearward end of the lower abutting surface 134*c*. It is contemplated that in other embodiments, the tapered recess 130 could be tapered such that a lateral width thereof could change along a length of the right bracket 110*b*. It is also to be noted that in other embodiments, the insert 132 could be omitted, and the tapered recess 130 could be defined by the bottom wall 114 and the sidewalls 116. The insert 132 defines apertures 136 (FIG. 6) that are aligned with the rear apertures 124, and that are configured to receive the right locking element 125*b* therein.

Referring back to FIGS. 3 to 7, the front support 140 will now be described in greater detail. The front support 140 has the left member 142*a*, the right member 142*b*, and the middle member 142*c*. The left and right members 142*a*, 142*b* are laterally spaced from one another and are interconnected by the middle member 142*c* so as to generally form an upside-down U-shape. The left member 142*a* includes a front segment 152*a* and a rear segment 154*a*, the right member 142*b* includes a front segment 152*b* and a rear segment 154*b*, and the middle member 142*c* includes a front segment 152*c* and a rear segment 154*c*. The front segments 152*a*, 152*b*, 152*c* are longitudinally spaced from the rear segments 154*a*, 154*b*, 154*c*, and are interconnected by reinforcing members 158. More specifically, the reinforcing members 158 each have a front end welded to one of the front segments 152*a*, 152*b*, 152*c* and a rear end welded to one of the rear segments 154*a*, 154*b*, 154*c*. The reinforcing members 158 provide rigidity to the front support 140. The support frame assembly 102 also includes a left panel 160*a* connected to the left member 142*a*, and a right panel 160*b* connected to the right member 142*b*. Each one of the left and right panels 160*a*, 160*b* defines a recess 162 therethrough, for, as will be described below, receiving part of the bimini tiedowns 92*a*, 92*b* therethrough. The left and right panels 160*a*, 160*b* can also assist in providing rigidity of the front support 140. It is contemplated that in other embodiments, the front support 140 could have a single segment or could have three or more segments.

As mentioned above, the front support 140 is pivotable relative to the boat 50 between the upright and stowed positions. In the illustrated embodiment, the left member 142*a* is pivotally connected to the left bracket 110*a*, and the right member 142*b* is pivotally connected to the right bracket 110*b*. More specifically, the left member 142*a* is partially received in the channel 118 of the left bracket 110*a*, and is pivotally connected to the left bracket 110*a* by the front segment 152*a* via the fastener 121. Likewise, the right member 142*b* is partially received in the channel 118 of the right bracket 110*b*, and is pivotally connected to the right bracket 110*b* by the front segment 152*b* via the fastener 121. It is contemplated that in other embodiments, the front support 140 could be pivotally connected to another part of the boat 50 instead of the left and/or right brackets 110*a*, 110*b*. For example, the front support 140 could be pivotally connected to the deck 60 or to the barrier structure 90. It is to be noted that in the illustrated embodiment, the left and right brackets 110*a*, 110*b*, due to their configuration (open-ended front, top and rear sides), do not limit the pivotal motion of the front support 140. The support frame assembly 102 is configured such that when the front support 140 is in the upright position, the front support 140 extends upward and longitudinally forward from the left and right brackets 110*a*, 110*b*. Thus, while in the upright position, the front support 140 is at a non-perpendicular angle about a horizontal plane. The left and right members 142*a*, 142*b* of the front support 140 are generally parallel to the lower abutting surface 134*c*. On the other hand, while in the stowed position, the front support 140 extends generally parallel to a horizontal plane and/or to an upper surface of the barrier structure 90.

The left member 142*a* has a tapered end 170*a*, and the right member 142*b* has a tapered end 170*b*. Since the tapered ends 170*a*, 170*b* are similar, only the tapered end 170*b* will be described herewith.

The tapered end 170*b* extends from an extremity of the rear segment 154*b* of the right member 142*b*. In some embodiments, the tapered end 170*b* could be provided on the front segment 152*b*. The tapered end 170*b* is complementary to and engageable with the tapered recess 130 of the right bracket 110*b*. As such, the tapered end 170*b* is tapered such that, with reference to FIG. 5, when the front support 140 is in the upright position, a width of the tapered end 170*b* proximate to an upper surface 173 is wider than the width of the tapered end 170*b* proximate to a bottom surface 174*c*. In other words, a width between lateral surfaces 174*a*, 174*b* decreases from the upper surface 173 toward the bottom surface 174*c*. As will be described in greater detail below, the tapered configuration of the tapered end 170*b* and the tapered recess 130 can assist in aligning the left and right members 142*a*, 142*b* with the left and right brackets 110*a*, 110*b* and reduce vibrations transmitted between the front support 140 and the left and right brackets 110*a*, 110*b*.

The tapered end 170*b* defines a locking recess 172 (FIGS. 5 and 6) that is sized to at least partially receive the locking element 125*b* therein. The locking recess 172 is positioned along the tapered end 170*b* such that when the tapered end 170*b* is received in the tapered recess 130, the locking recess 172 is generally aligned with the rear aperture 124 of the sidewalls 116, and the apertures 136 of the insert 132. Due to the locking recess 172, the tapered end 170*a* generally has a hook-like shape. As will be described below, the locking recess 172 is configured to receive the locking element 125*b* therein, and the locking element 125*b* is configured to abut the tapered end 170*b* for preventing movement thereof. In some embodiments, the recess 172 could be omitted. A rear section of the tapered end 170*b* is sloped, such that when the tapered end 170*b* is received in the tapered recess 130, the tapered end 170*b* does not protrude from the insert 132 (see FIG. 6).

It is contemplated that in other embodiments of the present technology, the left and right members 142*a*, 142*b* could each have the tapered recess and the left and right brackets 110*a*, 110*b* could each have the tapered ends. In yet other embodiments, one of the left and right members 142*a*, 142*b* could have the tapered recess, the corresponding one of the left and right brackets 110*a*, 110*b* could have the tapered end, the other one of the left and right members 142*a*, 142*b* could have the tapered end, and the corresponding one of the left and right brackets 110*a*, 110*b* could have the tapered recess.

As mentioned above, the support frame assembly 102 also includes the left and right biasing members 180 for biasing the front support 140 toward the upright position, and generally maintaining the front support 140 in the upright position. It is contemplated that in other embodiments, there could be more or fewer than two biasing members. Since the left and right biasing members 180 are similar to one another, only the right biasing member 180 will be described herewith.

The right biasing member 180 is a tension spring. More specifically, the right biasing member 180 is a gas traction spring. A front end of the right biasing member 180 is pivotally connected to the rear segment 154*b* of the right member 142*b*, and a rear end of the right biasing member 180 is pivotally connected to the right bracket 110*b* via the fastener 123. Thus, the right biasing member 180 biases the right member 142*b*, and thus biases the front support 140, toward the upright position thereof. It is contemplated that the configuration of the right biasing member 180 may vary from one embodiment to another. For example, in some embodiments, one end of the right biasing member 180 could be connected to the barrier structure 90 instead of the right bracket 110*b*. In other embodiments, the right biasing member 180 could be a compression spring instead of a tension spring, and could be connected to front support 140 and the boat 50 accordingly (e.g., one end could be connected to the barrier structure 90).

The locking elements 125*a*, 125*b* are configured to engage with the tapered ends 170*a*, 170*b* as well as the brackets 110*a*, 110*b* for locking the support frame assembly 102 in the upright position. To do so, once the support frame assembly 102 is in the upright position, and the tapered ends 170*a*, 170*b* are received in their respective tapered recesses 130, the locking elements 125*a*, 125*b* are received through the respective middle apertures 125 of the sidewall 116, through the respective apertures 136 of the insert 132 and through the locking recess 172. Thus, the locking elements 125*a*, 125*b* abut the tapered ends 170*a*, 170*b* to prevent movement of the tapered ends 170*a*, 170*b* relative to the brackets 110*a*, 110*b*. Each of the locking elements 125*a*, 125*b* is a ball locking pin having a handle 190. Each of the handles 190 enables the operator to easily grasp onto the locking elements 125*a*, 125*b*. It is contemplated that the configuration of the handles 190 could vary from one embodiment to another. For example, in some embodiments, the handles 190 could define an aperture for receiving fingers therein.

With continued reference to FIGS. 3 to 7, the rear support 104 is pivotally connected to the front support 140 about a pivot axis 201 (shown in FIG. 2), and is pivotable between an open position (shown in FIGS. 1 to 3) and a closed position (shown in FIG. 7). The rear support 104, similar to the front support 140, has a left member 202*a*, a right member 202*b* and a middle member 202*c* that generally form an upside-down U-shape. The left member 202*a* has a tension connector 206*a*, and the right member 202*b* has a tension connector 206*b*. The tension connectors 206*a*, 206*b*, which are moveable along the left and right members 202*a*, 202*b*, each have a crossbar 209 (FIG. 4). As will be described in greater detail below, the tension members 108*a*, 108*b* are selectively connected to the tension connectors 206*a*, 206*b* via the crossbars 209. While the front support 140 is in the upright position, and the rear support 104 is in the open position, the left and right members 202*a*, 202*b* extend upward and longitudinally rearward from the pivot axis 201. As a result, the top 106, which is connected to the front support 140 and the rear support 104, is taut.

The intermediate support 105, which is pivotally connected to the rear support 104 about a pivot axis 211 (shown in FIG. 2), is pivotable between a deployed position (shown in FIGS. 1 to 3) and a retracted position (shown in FIG. 7). The intermediate support 105, similarly to the front support 140, has a left member 212*a*, a right member 212*b* and a middle member 212*c* that generally form an upside-down U-shape. Each one of the left and right members 212*a*, 212*b* has a bumper 216 and a bumper 218 (FIG. 7). The bumpers 216, 218 extend away from their respective left or right member 212*a*, 212*b* in opposite direction. As will be described in greater detail below, the bumpers 216 are configured to bump against the front support 140, and the rear bumpers 218 are configured to abut against the rear support 104.

While the front support 140 is in the upright position, and the rear support 104 is in the open position, the intermediate support 105 is configured so that in the deployed position thereof, the left and right members 212*a*, 212*b* extend upward and forward from the pivot axis 211. Thus, the intermediate support 105 is generally configured to extend between the front and rear supports 140, 104. On the other hand, in the retracted position, the left and right members 212*a*, 212*b* of the intermediate support 105 are generally parallel to the left and right members 202*a*, 202*b* of the rear support 104.

The bimini 100 also has the left and right tension members 108*a*, 108*b* connected to, respectively, the left and right brackets 110*a*, 110*b* and the left and right members 202*a*, 202*b* of the rear support 104. It is contemplated that in other embodiments, the left and right tension members 108*a*, 108*b* could be connected to the left and right members 202*a*, 202*b* and to another part of the boat 50, such as, for example, the barrier structure 90. The left and right tension members 108*a*, 108*b* are configured to, when the bimini 100 is in the extended configuration, keep the rear support 104 in the open position. This can assist in ensuring that the top 106 remains taut.

Figure 3:
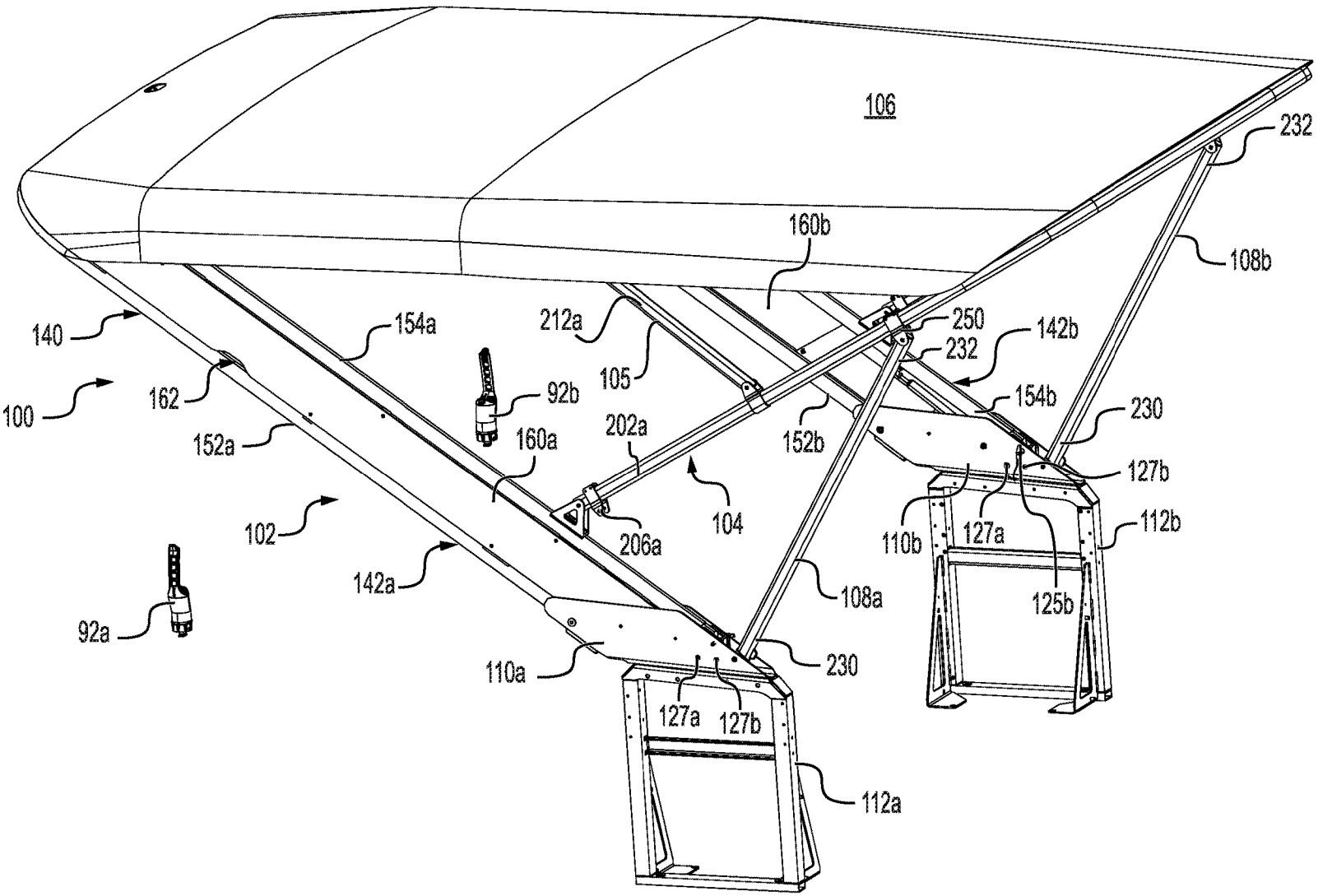
FIG. 3 is a perspective view taken from a top, rear, left side of the bimini of FIG. 1 connected to anchoring structures, the bimini being in an extended configuration.

As the left and right tension members 108*a*, 108*b* are generally similar to one another, only the right tension member 108*b* will be described herewith. Referring to FIGS. 3 and 6, the right tension member 108*b* has an end 230 for selectively connecting to the right bracket 110*b*, and an end 232 connected to the right member 202*b*.

At the end 230, the right tension member 108*b* defines a recess 234 that is sized to receive the crossbars 129, 209, and has a latch 240 that is pivotable about a pivot axis 241. The latch 240 has a hook portion 242, a biasing portion 244 and a lever portion 246. The latch 240, as it connects and disconnects to the crossbar 129, will now be described with reference to FIG. 6. In an initial position of the latch 240, the hook portion 242 generally extends into the recess 234, and is configured to hook onto the crossbar 129 of the right bracket 110*b*. The biasing portion 244 abuts part of the right tension member 108*b*, and is resiliently deformable. Upon resilient deformation, the biasing portion 244 biases the latch 240 toward the initial position. The lever portion 246 extends from a rear side of the right tension member 108*b*, and is actuable by an operator. Thus, when right tension member 108*b* is connected to the right bracket 110*b*, the crossbar 129 is received into the recess 234. The crossbar 129 abuts the hook portion 242, and due to a shape of the hook portion 242 and the resilient nature of the biasing portion 244, the hook portion 242 will snap onto the crossbar 129, thereby connecting the right tension member 108*b* to the right bracket 110*b*. When the tension member 108*b* is to be disconnected from the right bracket 110*b*, the lever portion 246 is actuated, thereby causing the latch 240 to pivot about the pivot axis 241 such that the hook portion 242 disengages from the crossbar 129. The right tension member 108*b* can thus be moved away from the right bracket 110*b*. Once the lever portion 246 is released, the biasing portion 244 biases the latch 240 back toward the initial position. The latch 240 connects to the crossbar 209 similarly. When the right tension member 108*b* is connected to the rear support 104, the crossbar 209 is received into the recess 234. The crossbar 209 abuts the hook portion 242, and due to the shape of the hook portion 242 and the resilient nature of the biasing portion 244, the hook portion 242 snaps onto the crossbar 209, thereby connecting the right tension member 108*b* to the rear support 104. The latch 240 can be disconnected from the crossbar 209 as described above with reference to the crossbar 129, by actuating the lever portion 246 to cause the hook portion 242 from disengaging from the crossbar 209.

The end 232 is connected to the right member 202*b* such that a position of the connection between the end 232 and the right member 202*b* is adjustable. The end 232 is connected to the right member 202*b* via a moveable bracket 250. The bracket 250 is pivotally connected to the end 232, and slideable along the right member 202*b*. The moveable bracket 250 is provided with two fasteners which can be fastened to prevent movement of the moveable bracket 250 relative to the right member 202*b*. This can be useful, because over time, the top 106 may stretch, and a position of the tension members 108*b* may need to be adjusted to ensure that the top 106 remains taut.

Referring back to FIGS. 3, the bimini 100 in the extended configuration will now be described.

In the extended configuration, the front support 140 is in the upright position, such that the front support 140 extends toward the front side of the boat 50 at an angle to the barrier structure 90. With the front support 140 in the upright position, the tapered ends 170*a*, 170*b* are received in respective tapered recess 130 such that the surfaces 174*a*, 174*b*, 174*c* of the tapered ends 170*a*, 170*b* abut, respectively, the surfaces 134*a*, 134*b*, 134*c* of the respective inserts 132. Due to the ends 170*a*, 170*b* and the recesses 130 being tapered, movement therebetween is limited. Also, since the left and right biasing members 180 bias the front support 140 toward the upright position, the tapered ends 170*a*, 170*b* are pushed into the tapered recesses 130. Additionally, in this extended configuration, the locking elements 125*a*, 125*b* are connected to their respective brackets 110*a*, 110*b* as described hereabove to further prevent movement between the front support 140 and the left and right brackets 110*a*, 110*b*. As a result at least in part of this connection, the boat 50 may travel with the bimini 100 in the extended configuration at relatively high speeds, in some cases around 90 kilometers per hour, due to the complementary connection of the tapered ends 170*a*, 170*b* and the tapered recesses 130. Additionally, due to the abutment of the surfaces 134*a*, 134*b*, 134*c* with the surfaces 174*a*, 174*b*, 174*c*, there is less vibration transmission from the brackets 110*a*, 110*b* to the front support 140, and vice versa. This can limit noise generated by the bimini 100 during use.

The left and right tension members 108*a*, 108*b* are connected to the left and right brackets 110*a*, 110*b* as described above and to the rear support 104. The left and right tension members 108*a*, 108*b* assist in maintaining the rear support 104 in the open position and the position of the moveable brackets 250 is adjusted to ensure that the top 106 is taut.

The intermediate support 105 is in the deployed position, and extends toward the front side of the boat 50, generally parallel to the front support 140. The intermediate support 105 provides support to the top 106 between the front and rear supports 140, 104.

It is contemplated that the orientation of the bimini 150 could be reversed.

With reference to FIGS. 3 and 7, the manner in which the bimini 100 is moved from the extended configuration to the collapsed configuration will now be described.

The tension members 108*a*, 108*b* are disconnected from respective brackets 110*a*, 110*b*, by actuating the lever portions 246 of the latches 240 for disengaging the hook portions 242 from their respective crossbars 129.

Then, the rear support 104 is moved toward the closed position, and the intermediate support 105 is moved toward the retracted position. It is to be noted that the rear support 104 is to be moved before the intermediate support 105 due to the top 106 otherwise limiting movement of the intermediate support 105.

To avoid the tension members 108*a*, 108*b* from moving freely, each end 230 of the tension members 108*a*, 108*b* is connected to the left and right members 202*a*, 202*b* via the tension connectors 206*a*, 206*b*. More specifically, each hook portion 242 of the latches 240 is engaged with a respective crossbar 209 of the tension connectors 206*a*, 206*b*. The position of the tension connectors 206*a*, 206*b* can be, if needed (i.e., based on a position of the moveable brackets 250), moved.

In some instances, the bimini 100 could be left in this intermediate configuration, in which the front support 140 is in the upright position, the rear support 104 is in the closed position and the intermediate support 105 is in the retracted position.

The locking elements 125*a*, 125*b* are then removed from their respective middle apertures 125, apertures 136, and locking recesses 172.

To move the bimini from the intermediate configuration to the collapsed configuration, the front support 104 can be moved toward the stowed position. To do so, the user will have to counteract the biasing forces of the biasing members 180. However, due to the weight of the front support 104 and other components connected thereto, the user does not need to exert much effort to lower the front support 140 toward the stowed position.

In the collapsed configuration, the front, rear and intermediate supports 140, 104 are configured to be stackable. The bumpers 216, 218 assist in providing stability to the stacked front, rear and intermediate supports 140. Specifically, in the collapsed configuration, the bumpers 216 are disposed between the front support 140 and the intermediate support 105, and the bumpers 216 are disposed between the intermediate support 105 and the rear support 104.

To secure the bimini 100 in the collapsed configuration, the bimini 100 can further be tied down by the bimini tiedowns 92*a*, 92*b*. To do so, part of the bimini tiedowns 92*a*, 92*b* is passed through the recesses 162 of the side panels 160*a*, 160*b*.

It is contemplated that the order in which the above steps are performed may vary. For example, it is contemplated that in some embodiments, the locking elements 125*a*, 125*b* could be removed from their respective middle apertures 125, apertures 136, and locking recesses 172 before moving the rear support 104 toward the closed position and the intermediate support 105 toward the retracted position.

To return the bimini 100 from the stowed configuration to the extended configuration, the above steps are performed in the reverse order. One will note, however, that as the front support 140 (and other components connected thereto) is moved toward the upright position, the biasing members 180 assist the user, such that effort to be exerted by the user to adjust the configuration of the bimini 100 is limited. Also, in some instances, once the front support 140 is in the upright position, the biasing members 180 are configured to maintain the front support in its position such that the user does not need to hold the front support 140 while inserting the locking elements 125*a*, 125*b*.

Modifications and improvements to the above-described embodiments of the present technology may become apparent to those skilled in the art. The foregoing description is intended to be exemplary rather than limiting. The scope of the present technology is therefore intended to be limited solely by the appended claims.

What is claimed is:

1. An over-the-deck support frame assembly for a watercraft, the over-the-deck support frame assembly comprising:

a first bracket and a second bracket, the first and second brackets being connectable to the watercraft on opposite sides of a longitudinal center plane of the watercraft, and each one of the first and second brackets having one of a tapered end and a tapered recess; and a support having a first member and a second member laterally spaced from the first member, the first member being pivotable relative to the first bracket, the second member being pivotable relative to the second bracket, and each one of the first and second members having an other one of the tapered end and the tapered recess, each one of the other one of tapered end and the tapered recess being complementary to and engageable with the one of the tapered end and the tapered recess of a corresponding one of the first and second brackets, and the support being selectively pivotable between a stowed position and an upright position, and with the support in the upright position:

the other one of the tapered end and the tapered recess of the first member engaging the one of the tapered end and the tapered recess of the first bracket such that at least part of the other one of the tapered end and the tapered recess of the first member contacts at least part of the one of the tapered end and the tapered recess of the first bracket; and the other one of the tapered end and the tapered recess of the second member engaging the one of the tapered end and the tapered recess of the second bracket such that at least part of the other one of the tapered end and the tapered recess of the second member contacts at least part of the one of the tapered end and the tapered recess of the second bracket.

2. The over-the-deck support frame assembly of claim 1, wherein the first member is pivotally connected to the first bracket, and the second member is pivotally connected to the second bracket.

3. The over-the-deck support frame assembly of claim 1, wherein at least one of the one of the tapered end and the tapered recess of the first and second brackets is the tapered recess, and at least one of the other one of the tapered end and the tapered recess of the first and second supports is the tapered end.

4. The over-the-deck support frame assembly of claim 3, wherein each one of the one of the tapered end and the tapered recess of the first and second brackets is the tapered recess, and each one of the other one of the tapered end and the tapered recess of the first and second supports is the tapered end.

5. The over-the-deck support frame assembly of claim 1, further comprising at least one biasing member connected to the support for biasing the support toward the upright position.

6. The over-the-deck support frame assembly of claim 5, wherein the at least one biasing member has a first end pivotally connected to the support, and a second end pivotally connected to one of the first and second brackets.

7. The over-the-deck support frame assembly of claim 5, wherein the at least one biasing member is a traction spring.

8. The over-the-deck support frame assembly of claim 5, wherein the at least one biasing member includes a first biasing member and a second biasing member, the first biasing member being connected to the first member and to the first bracket, and the second biasing member being connected to the second member and to the second bracket.

9. The over-the-deck support frame assembly of claim 1, further comprising a locking element engageable with the support and one of the first and second brackets for locking the support in the upright position.

10. The over-the-deck support frame assembly of claim 9, wherein the locking element is a locking pin extending at least partially through at least one of: the one of the tapered end and the tapered recess of the one of the first and second brackets, and the other one of the tapered end and the tapered recess of a corresponding one of the first and second members.

11. The over-the-deck support frame assembly of claim 1, wherein each one of the first and second members has a front segment and a rear segment, the first and second members being pivotally connected to corresponding ones of the first and second brackets by the front segments, and the other one of the tapered end and the tapered recess being defined by the rear segments.

12. A bimini for a watercraft, the bimini comprising:

the over-the-deck support frame assembly of claim 1, wherein the support is a first support;

a second support pivotally connected to the first support, and moveable between an open position and a closed position; and a top extending between the first support and the second support, with the first support in the upright position, and the second support in the open position, the bimini being in an extended configuration, and the top being taut between the first and second supports.

13. The bimini of claim 12 further comprising a third support pivotally connected to the second support, and with the bimini in the extended configuration, the third support being pivotable to a position between the first and second supports for supporting the top.

14. The bimini of claim 12, further comprising at least one tension member for retaining the second support in the open position, a first end of the at least one tension member being connected to one of the first and second brackets, and a second end of the at least one tension member being connected to the second support, a position of a connection between the second end of the at least one tension member and the second support being moveable along a length of the second support.

15. A watercraft comprising:

a hull, a deck disposed on the hull;

an over-the-deck support frame assembly comprising:

a first bracket connected to the watercraft, a second bracket connected to the watercraft, the first and second brackets being disposed on opposite sides of a longitudinal center plane of the watercraft, and each one of the first and second brackets having one of a tapered end and a tapered recess;

a first support having a first member pivotable relative to the first bracket, a second member pivotable relative to the second bracket, and each one of the first and second members having an other one of the tapered end and the tapered recess, each one of the other one of the tapered end and the tapered recess being complementary to and engageable with the one of the tapered end and the tapered recess of a corresponding one of the first and second brackets; and the first support being selectively pivotable between a stowed position and an upright position, and with the first support in the upright position:

the other one of the tapered end and the tapered recess of the first member engaging the one of the tapered end and the tapered recess of the first bracket such that at least part of the other one of the tapered end and the tapered recess of the first member contacts at least part of one of the tapered end and the tapered recess of the first bracket; and the other one of the tapered end and the tapered recess of the second member engaging the one of the tapered end and the tapered recess of the second bracket such that at least part of the other one of the tapered end and the tapered recess of the second member contacts at least part of the other one of the tapered end and the tapered recess of the second bracket.

16. The watercraft of claim 15, wherein the first bracket is connected to a first anchoring structure of the watercraft, and the second bracket is connected to a second anchoring structure of the watercraft.

17. The watercraft of claim 16, wherein the first and second anchoring structures extend above the deck of the watercraft.

18. The watercraft of claim 15, wherein with the first support being in the upright position, the first support is at a non-perpendicular angle about a horizontal plane.

19. The watercraft of claim 18, wherein with the first support being in the upright position, the first support extends longitudinally forward and vertically upward.

20. The watercraft of claim 15, further comprising:

a second support pivotally connected to the first support, and being moveable between an open position and a closed position; and a top extending between the first and second supports, and with the first support being in the upright position, and the second support being in the open position, the top is taut.

* * * * *